US006096991A

United States Patent [19]

Stone et al.

[11] Patent Number: 6,096,991

[45] Date of Patent: Aug. 1, 2000

[54] METHOD OF AND APPARATUS FOR SORTING A PARTICULATE MATERIAL

[75] Inventors: Alan Matthew Stone, Greensborough; Hilton Paul Gordon, Lindfield; Robert Jordan, Sorrento, all of Australia

[73] Assignee: Maurilastic Ltd., East Killara, Australia

[21] Appl. No.: 09/097,829

[22] Filed: Jun. 16, 1998

Related U.S. Application Data

[63] Continuation-in-part of application No. 08/527,639, Sep. 13, 1995, abandoned.

[30] Foreign Application Priority Data

Sep. 13, 1994 [AU] Australia ..... PM 8047
Oct. 6, 1994 [AU] Australia ..... PM 8613

[51] Int. Cl.[7] ..... B07C 5/00; B07C 9/00

[52] U.S. Cl. ..... 209/589; 209/576; 209/689

[58] Field of Search ..... 209/45, 576, 577, 209/587, 589, 643, 644, 684, 687, 689, 932, 62

[56] References Cited

U.S. PATENT DOCUMENTS

| | | | |
|---|---|---|---|
| 2,473,215 | 6/1949 | Orlund | 209/45 |
| 3,507,387 | 4/1970 | Alldred, Jr. et al. | 209/45 X |
| 3,661,256 | 5/1972 | Hain | 209/643 X |
| 4,247,392 | 1/1981 | Goncharov | 209/301 |
| 4,258,851 | 3/1981 | Lion et al. | 209/932 X |
| 4,347,130 | 8/1982 | Younge | 209/452 |
| 4,405,454 | 9/1983 | Hultsch et al. | 209/279 |
| 4,478,711 | 10/1984 | Cohen et al. | 209/39 |
| 4,523,993 | 6/1985 | Farber | 210/297 |
| 4,721,561 | 1/1988 | Oetiker et al. | 209/144 |
| 4,731,802 | 3/1988 | Magnusson et al. | 209/687 X |
| 5,163,565 | 11/1992 | Caskey | 200/687 |
| 5,206,699 | 4/1993 | Stewart et al. | 209/589 X |
| 5,260,598 | 11/1993 | Brass et al. | 250/574 |
| 5,535,893 | 7/1996 | Jameson | 209/164 |

FOREIGN PATENT DOCUMENTS

| | | |
|---|---|---|
| 83/9064 | 12/1983 | South Africa . |
| 650 871 | 8/1985 | Switzerland . |
| 624 663 | 9/1978 | U.S.S.R. . |

OTHER PUBLICATIONS

Patent Abstracts of Switzerland, abstract of Uzlov et al., "Sorter for Mineral Dressing" Swiss 574 231, Oct. 11, 1977.
Patent Abstracts of Switzerland, "Potash Separating Centrifuge With Rotor", Swiss 536 842, Jan. 20, 1977.

*Primary Examiner*—Donald P. Walsh
*Assistant Examiner*—Daniel K. Schlak
*Attorney, Agent, or Firm*—Foley & Lardner

[57] ABSTRACT

A sorting system wherein particulate material is dispersed by centrifugal force in a layer on an inner surface of a rotating drum, and particles which possess at least one predetermined characteristic are removed from the layer.

19 Claims, 5 Drawing Sheets

METHOD OF AND APPARATUS FOR SORTING A PARTICULATE MATERIAL

The instant application is a continuation-in-part of U.S. application Ser. No. 08/527,639 filed Sept. 13, 1995, which is abandoned.

BACKGROUND OF THE INVENTION

This invention relates to the sorting of particulate material. In this specification the word "material" includes any material that is in a particulate form and refers particularly to ores in the mining industry.

Many industries produce materials that are uneconomic to process by standard means as they are either contaminated by foreign bodies or have a low grade. These materials are generally not processed at all and are discarded.

SUMMARY OF THE INVENTION

The invention provides, in the first instance, an apparatus for sorting a particulate material which includes a drum which is mounted for rotation about its axis, means for feeding the particulate material into the drum which, due to centrifugal force produced by its rotation, causes a monolayer of the particulate material to adhere to an inner surface of the drum, means for detecting the presence of at least one predetermined characteristic in individual particles in the monolayer of the particulate material, and means for separating particles with the predetermined characteristic from the remaining particles.

The separating means may comprise at least one removal device which is responsive to the detection means. In one embodiment of the invention the drum is made from a solid or semi-permeable material and the material is removed from an inner surface of the drum by one or a plurality of the removal devices. Each removal device may be suction device.

In an alternative arrangement the removal means comprises at least one fluid ejection device which is responsive to the detection means. The drum inner surface may then be a perforated or slotted surface, or otherwise be formed with a plurality of apertures, and the fluid ejection device or devices may be directed from outside the drum, through the drum wall, to the particles adhering to the inner surface.

The fluid ejection devices may comprise compressed air jets, water jets or the like.

Depending on the type of particulate material mechanical separation devices may also be employed. These may for example comprise flapper gates or similar devices which are movable to free selected particles directly from the inner surface of the drum.

The drum may, for example, be made from wedge wires and be similar to a trommel. The wedge wires may extend across the drum thereby forming a surface which includes a plurality of very fine slots.

Material remaining in the drum, after removal of those particles which possess the predetermined characteristic or characteristics, may be removed from the drum by means of suction, water spray, air jet or by means of a mechanical scraper.

The predetermined characteristic or characteristics depend on the nature of the material which is being sorted. The invention is not limited in this regard. For example the predetermined characteristic may comprise any one of the following diverse features: a photometric effect, reflectance or absorption criteria, radio-active emissions, a magnetic or conductive effect, optical fluorescence or the like. It may be that the predetermined characteristic or characteristics are emitted only in response to suitable stimulation. Thus it falls within the scope of the invention to stimulate the particles so that those particles that possess the predetermined characteristic or characteristics emit a signal which is indicative of the presence thereof.

For example, in the sorting of diamonds, the particulate material may be subjected to an X-ray source which stimulates the emission of fluorescence by the diamonds.

The invention provides, in a second instance, a method of sorting a particulate material which includes the steps of subjecting the particulate material to a centrifugal force thereby to form a monolayer of the particulate material so that individual particles are identifiable, detecting the presence of at least one predetermined characteristic in particles in the monolayer of the particulate material, and removing particles with the predetermined characteristic from the monolayer of the particulate material.

The particulate material may be subjected to the centrifugal force by feeding material into a rotating drum so that a monolayer of the particulate material is dispersed on an inner surface of the drum. Preferably the drum rotates at a speed which is sufficiently high to ensure that substantially a monolayer of the particulate material is formed.

The material may be fed continuously into the drum and the material remaining in the drum, after removal of the particles with the predetermined characteristic or characteristics, may be removed continuously from the drum.

Removal of material from the drum may be effected by means of suction or by means of fluid pressure or by mechanical means.

BRIEF DESCRIPTION OF THE DRAWINGS

The invention is further described by way of example with reference to the accompanying drawings in which.

DESCRIPTION OF PREFERRED EMBODIMENTS

Figure 1:
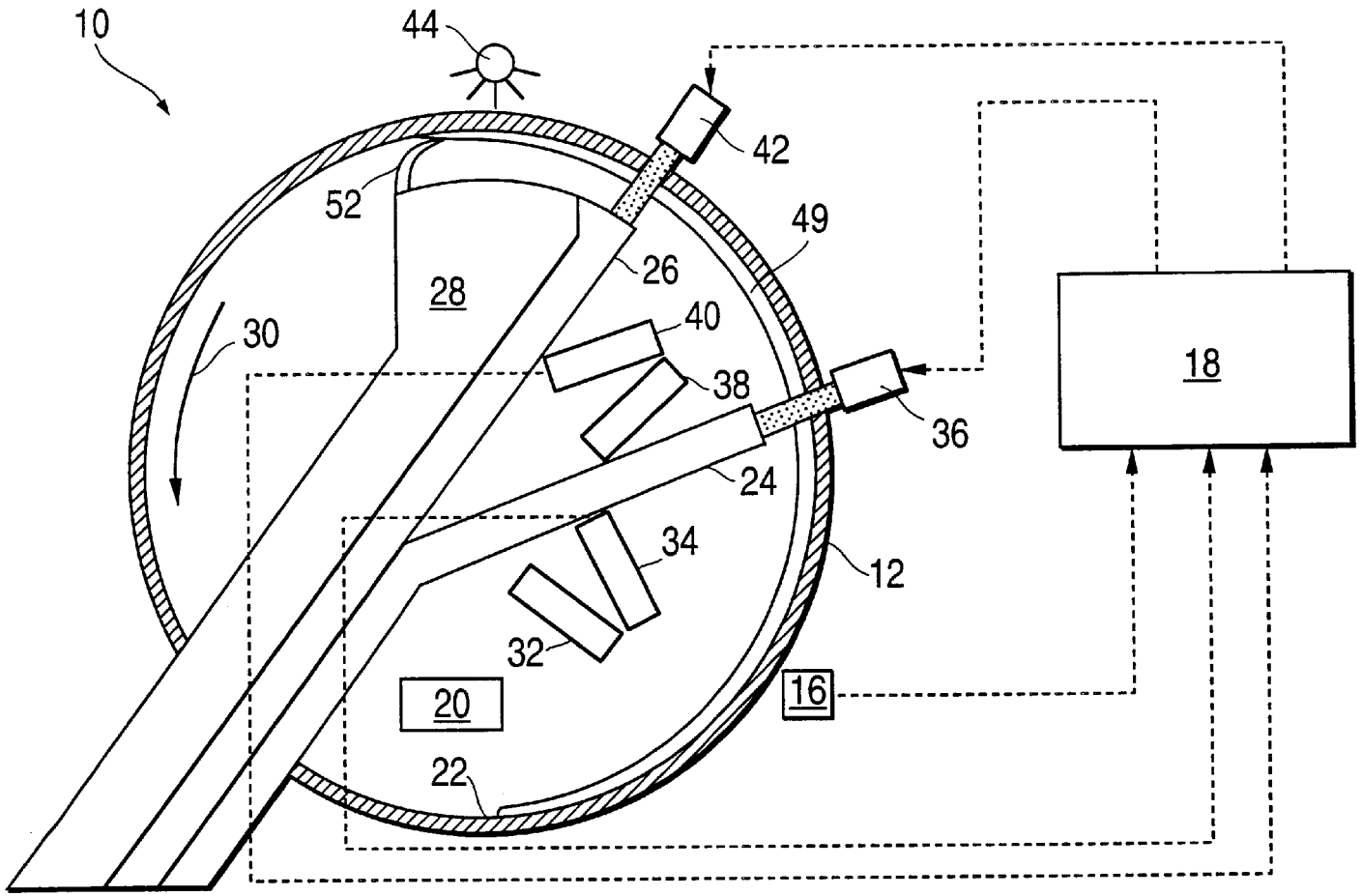
FIG. 1 is a somewhat schematic side view of sorting apparatus according to the invention.
Figure 2:
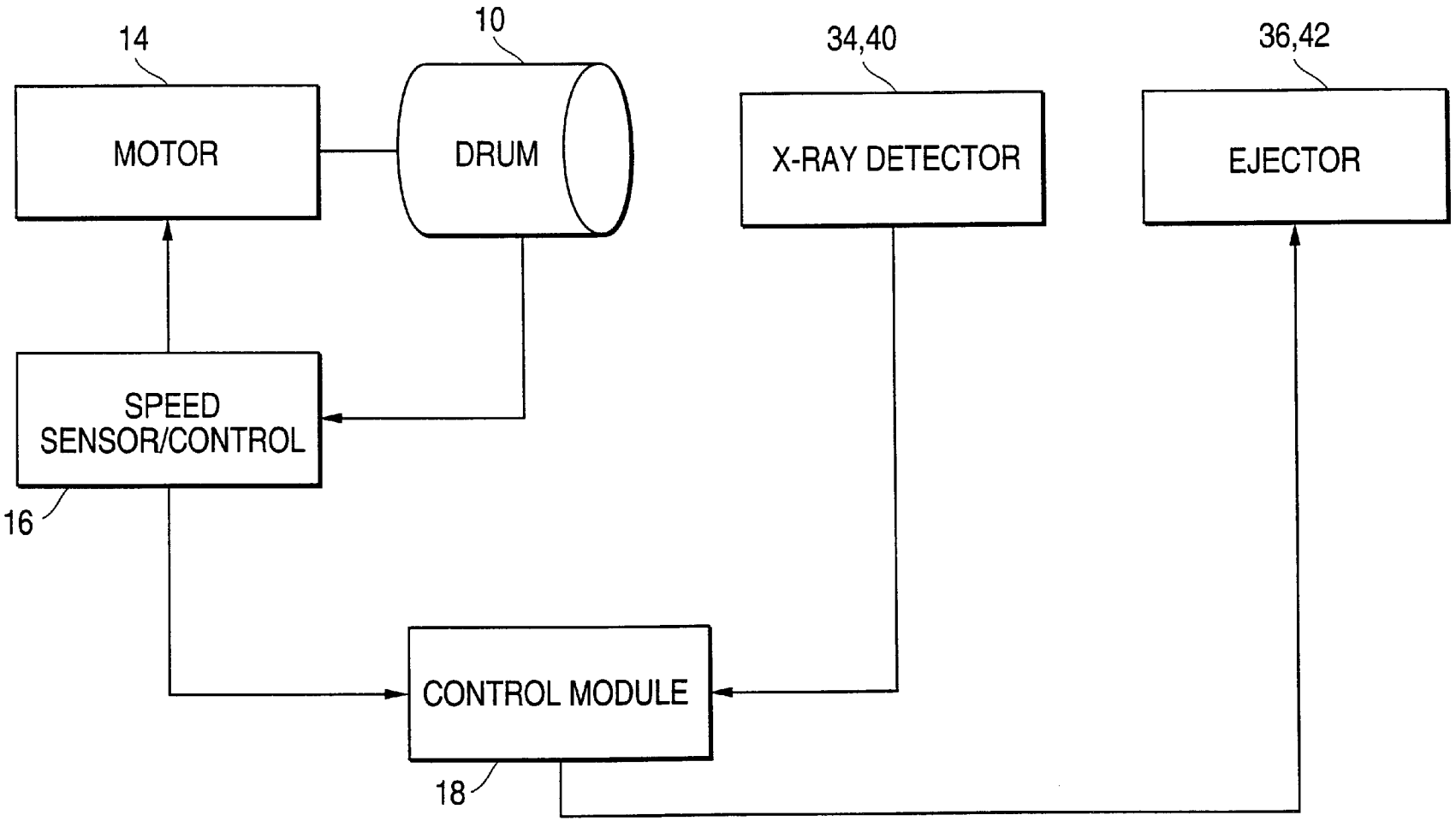
FIG. 2 is a block diagram of control circuitry for the sorting apparatus of FIG. 1.

FIGS. 1 and 2 of the accompanying drawings illustrate a sorting apparatus 10 according to one form of the invention. The apparatus includes a drum 12 which is mounted for rotation about a horizontal axis. The drum is driven by means of an electrical motor 14 and, where required, use is made of a gear box or similar drive transmission system, not shown, between the motor and the drum.

The rotational speed of the drum is monitored by means of a sensor 16. A signal produced by the sensor, which is indicative of the rotational speed of the drum, is applied to a control module 18 which in turn operates to drive the motor 14 so that the rotational speed of the drum is known and kept substantially constant.

The sensor or control module may include suitable switching circuitry to adjust the rotational speed of the drum to a fixed desired speed and to stop the motor in the case of a malfunction.

The feed chute 20 extends into the drum, in a lower region of the drum. The feed chute may be of any suitable construction and may, for example, contain an endless conveyor belt which carries particulate material into the drum, depositing the material at one or a number of points onto an inner surface 22 of the wall of the drum.

Three collecting chutes 24, 26 and 28 extend from the interior of the drum. The drum is rotated in the direction of an arrow 30 and the chutes are spaced from one another in this direction of rotation. The chutes 24 and 26 are relatively low capacity chutes while the chute 28 has a higher capacity.

The chutes are oriented so that material entering the upper mouth of a chute moves under gravity action down the chute.

The apparatus 10, in this example of the invention, is intended to be used for the sorting of diamondiferous particulate material. It is known that diamonds can be excited, by means of suitable X-ray sources, to emit fluorescence. To make use of this characteristic, an X-ray source or a plurality of X-ray sources 32 are placed in line, in the interior of the drum, extending across the horizontal length 46 of the drum. The arrangement is such that the whole drum surface which passes in front of the array of X-ray sources is irradiated with X-rays. One or a plurality of X-ray detectors 34 are similarly positioned across the interior of the drum, to detect X-ray emissions which may be stimulated by the X-ray sources. The position of each X-ray detector is known with respect to the horizontal length of the drum. Each X-ray detector therefore monitors a particular track, of a predetermined width, on the inner surface 22 of the drum.

An air or water ejector 36, or a plurality of the ejectors, are positioned opposite the mouth of the chute 24.

A second array of X-ray sources 38, and a corresponding array of X-ray detectors 40, are positioned downstream of the chute 26. The X-ray sources 38 are similar to the sources 32 and the detectors 40 are similar to the detectors 34. Air or water ejectors 42, similar to the ejectors 36, are positioned opposite the mouth of the chute 26.

Additional air or water ejectors 44 are positioned opposite the mouth of the chute 28.

Figure 3:
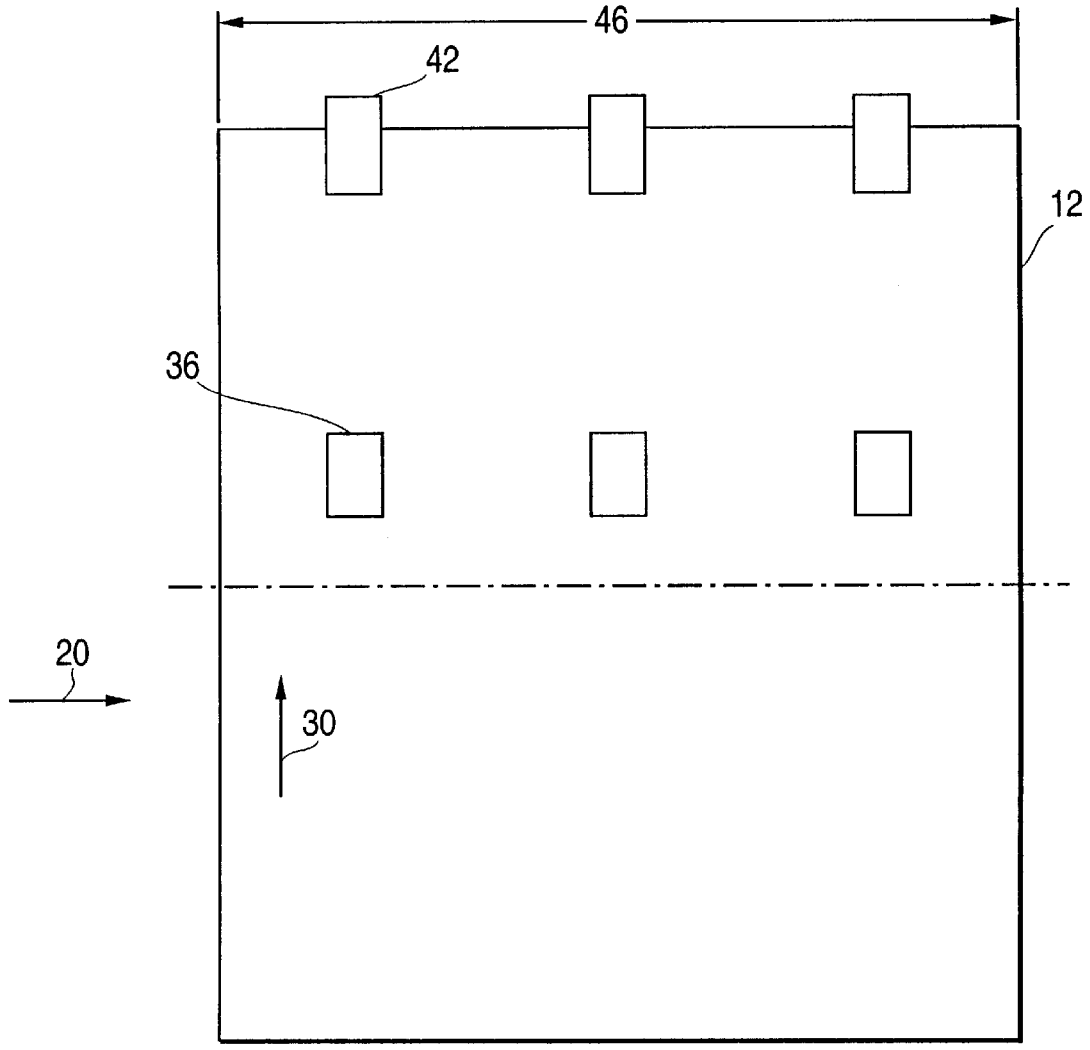
FIG. 3 is a schematic view in elevation of a drum in the apparatus of FIG. 1.

Reference should be made to FIG. 3 which schematically illustrates the ejectors 36 and 42 extending in two arrays which are spaced from one another in the rotational direction 30 of the drum and which extend across the horizontal width 46 of the drum.

Figure 4:
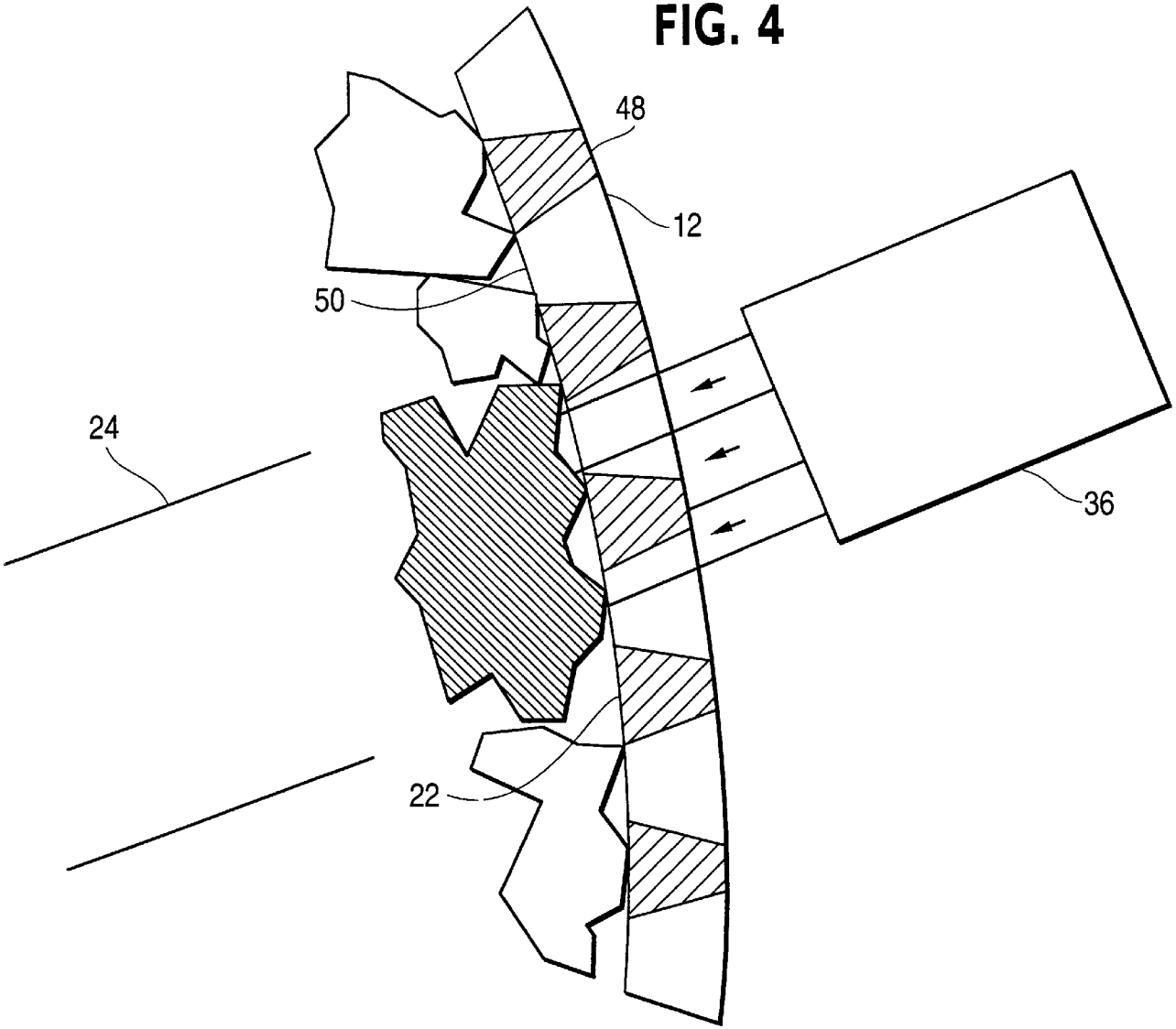
FIG. 4 is a sectioned side view, on an enlarged scale, of a drum suitable for use in the apparatus of FIG. 1.

The drum 12 includes a wall which is formed with a plurality of apertures. The apertures may be provided in any suitable way and the drum wall may for example be formed with a plurality of perforations. Alternatively, however, as is shown in the partial cross-sectional illustration of the drum in FIG. 4, the drum is formed from a plurality of wedge wires 48 which extend across the drum surface to form a plurality of very fine slots 50 between adjacent wedge wires.

Material which is to be sorted is fed via the chute 20 into the interior of the drum. The drum is rotated by means of the motor 14 and, due to centrifugal force, the material is caused to adhere in a monolayer 49 to the inner surface of the drum. The rotational speed is sufficiently high, or alternatively use is made of mechanical dispersion devices, to ensure that the material on the inner surface of the drum is held in a monolayer with the particulate material separated so that individual particles are identifiable.

The rotating material is presented to the X-ray sources 3;2 and the diamonds in the material are stimulated to emit fluorescence. The fluorescing particles are detected by the detectors 34 and control signals are fed by the detectors to the control module 18. As the rotational speed of the drum is known and as the position of each particle, in the longitudinal sense, is known from the particular detector 34 which detects the emission of fluorescence from the particle in question, it is possible for the control module 18 to cause the corresponding ejector 36 to be actuated as the fluorescent particle passes the mouth of the chute 24. By firing the ejector at the right time an air or water jet is directed through the appropriate portions of the corresponding slots 50 and the particle or particles adhering to the inner surface 22 are displaced from the drum and are directed into the chute 24.

In this example of the invention there are two stimulating and detection sections. Thus after the particulate material has passed the chute 24, the material is again subjected to X-ray stimulation by means of the sources 38 and fluorescing particles are detected by the detectors 40 and are then displaced by the ejectors 42 into the chute 26.

Material remaining on the inner surface 22 is displaced into the chute 28 by means of the ejectors 44. These ejectors could be replaced by means of a mechanical scraper device 52 which simply removes all material from the surface 22 and directs it into the chute 28 which feeds the reject material to a waste collection point.

The material which is fed via the chute 20 into the interior of the drum, may be fed in wet or dry form. For very fine wet material the bottom of the drum could be in a trough of water. The material is flung onto the inner surface 22 by the centrifugal force generated due to the drum rotating and most of the moisture is moved. The material remains in a stable position on the surface 22 and is transported in a monolayer to the stimulating and detection sections.

The control module 18 calculates whether the detected particles are of accept or reject quality. The accepted particles, which are the minority part of the feed, are removed by means of the accept ejectors 36 and 42.

The principles of the invention may be used with particulate material which ranges in size from a fine size to relatively coarse material.

It is not necessary to make use of gas or fluid ejectors. These devices could be replaced by means of suction systems which suck selected particles from the inner surface 22. In this variation of the invention the drum wall may be solid or be made from a semi-permeable material.

The invention has been described with reference to the removal of desired component s from a monolayer of the particulate material. The invention can be used in a different sense in that contaminants can initially be removed from the particulate material and the remaining material, which is then the desired component, can be collected in the chute 28. For example if the particulate material includes a food product such as rice or beans then damaged grains or beans can be removed, or dangerous inclusions such as glass or grit can be separated, from the food product. This sorting technique is based on visual differences which are detectable without prior stimulation.

In an alternative arrangement the removal means comprises at least one fluid ejection device which is responsive to the detection means. The drum inner surface may then be a perforated or slotted surface, or otherwise be formed with a plurality of apertures, and the fluid ejection device or devices may be directed from outside the drum, through the drum wall, to the particles adhering to the inner surface.

The fluid ejection devices may comprise air jets, water jets or the like.

Figure 5:
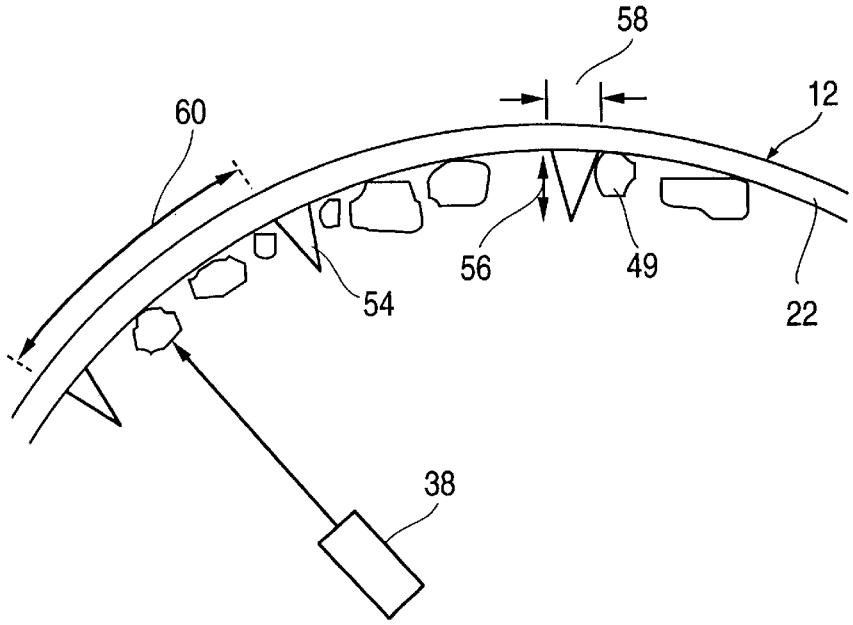
FIG. 5 illustrates a modification of the drum.

FIG. 5 illustrates a modification which is made to the inner surface 22 of the drum 12 to overcome a problem which may arise during operation particularly with certain types of rocks or ore.

The material which is introduced into the drum through the feed chute 20 is initially substantially stationary relatively to the rotational movement of the drum. The material impinges on the inner surface 22 of the drum and must be accelerated, to the rotational speed of the drum, in order to adhere to the drum surface in a monolayer in which the individual particles are separately identifiable and are held in fixed positions relatively to each other and to the drum. This latter aspect is important for once a desirable particle has been detected its position must remain substantially unaltered up to the time that the separating step, which removes the detected particles from the remaining material, is initiated.

It has been found that the particulate material, once introduced into the drum, may not adhere to the inner wall of the drum in a stable manner. The drum, as stated, is rotating at a relatively high speed and the particulate material may slide, under gravity action, downwardly relatively to the direction of rotational movement of the drum. The sliding particulate material may or may not stabilise i.e. adhere securely to the inner surface 22. Under certain conditions, which are not easily understood, an "avalanche" type effect ensues and the system becomes unstable in that the particulate material detaches from the inner surface 22 and falls downwardly landing inside or outside the drum. When this happens there is no likelihood of sorting taking place.

FIG. 5 illustrates a modification which has been found to prevent the build up of unstable conditions. The inner surface 22 includes ribs or strips 54 which extend across the horizontal length 46 of the drum. Each rib has a height 56 of approximately 4 mm and a base width 58 of approximately 2,5 mm. The ribs are spaced apart from each other in the circumferential direction of the drum by a distance 60 which is of the order of 75 mm.

As is evident from FIG. 5 each rib, in cross-section, is tapered and hence has a triangular shape.

When the particulate material is introduced into a drum, modified as shown in FIG. 5, then the individual particles which may slide on the inner drum surface are caught by the ribs and thereafter build up against one another in a monolayer. The particles are held in the monolayer by the centrifugal force which is generated by the rotation of the drum. Although the ribs are relatively small their effect is significant and they prevent the avalanche type action referred to hereinbefore.

The ribs should not, in themselves, interfere with the stimulating devices, e.g. the X-ray sources 38, which may be used to illuminate the particles in the monolayer 49. It is for this reason that the ribs are tapered in cross-section for this helps to reduce any "shadow" which could, for example, be produced by a rib of rectangular or square cross-section.

Figure 6:
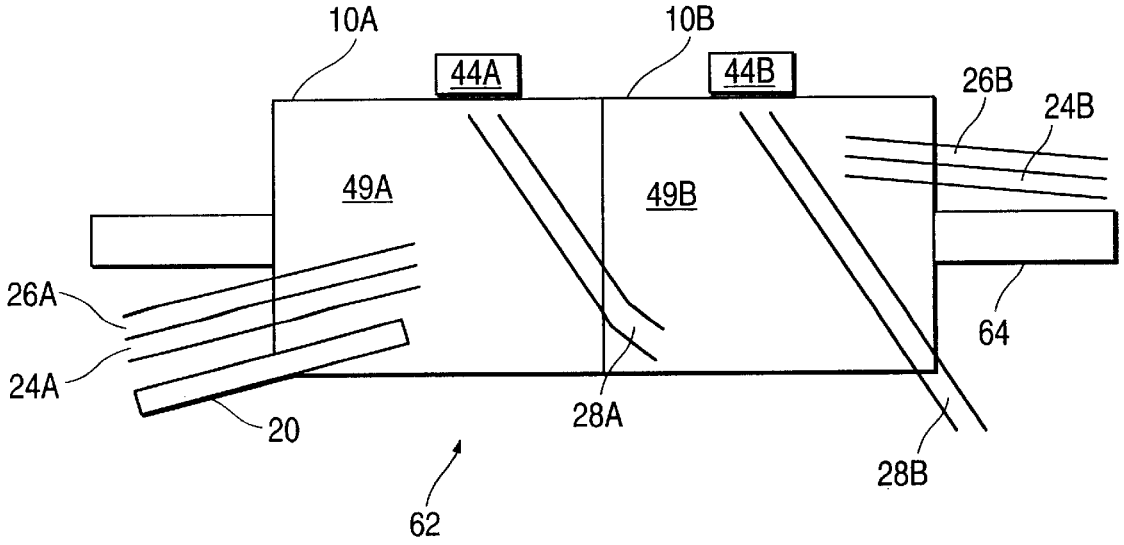
FIG. 6 illustrates a development of the invention.

FIG. 6 schematically illustrates a further modification which can enhance the sorting efficiency of the apparatus of the invention. FIG. 6 illustrates, from the side, a compound drum 62 which has two sub drum sections designated 10A and 10B respectively. Each sub-section is essentially the same as the drum 10 referred to in connection with FIGS. 1 to 4.

The drum 62 is rotatable about an axle 64.

A feed chute 20, similar to what has been described in connection with FIG. 1, deposits material into the drum 10A. A monolayer 49A of the material is formed on an inner surface of the drum section 10A, in the manner which has been described hereinbefore. Sorting or separation takes place, again in the manner which has been described hereinbefore and collecting chutes 24A and 26A respectively direct desirable detected material, separated from the monolayer, to collecting devices outside of the interior of the drum section.

Material which remains on the inner surface of the drum section is directed into a collecting chute 28A. In contrast to what has been described hereinbefore however the chute 28A directs this material into the drum section 10B and not to a waste collection point.

The material in the drum section 10B is subjected to a process which is identical to that which takes place in the drum section 10A in that the material is initially dispersed into a monolayer 49B in which individual particles are identifiable and thereafter the monolayer is subjected to a sorting process. Desirable particles are separated and are directed into collecting chutes 24B and 26B respectively and waste material is directed into a chute 28B.

The arrangement shown in FIG. 6 thus has a two-pass capability which is implemented in a continuous fashion in that reject material from the first pass i.e. the first drum section is immediately subjected to a second pass or sorting procedure.

The cost involved in processing the waste material in the second pass, as described, is relatively low and in practically all circumstances is justified by the additional recovery of desirable material which is achieved.

It is apparent that the technique shown in FIG. 6 is not confined to a two-pass system but can be implemented repeatedly in order to achieve a desired recovery rate.

What is claimed is:

1. Apparatus for sorting a particular material, comprising:

a drum which is mounted for rotation about its axis;

means for feeding the particulate material into the drum which, due to centrifugal force produced by its rotation, causes a monolayer of the particulate material to adhere to an inner surface of the drum;

means for stimulating the particulate material so that particles which possess at least one predetermined characteristic emit a signal which indicates the presence of the predetermined characteristic;

means for detecting the presence of the at least one predetermined characteristic in individual particles in the monolayer of the particulate material; and means for separating particles with the at least one predetermined characteristic from the remaining particles.

2. Apparatus according to claim 1 wherein the separating means comprises at least one suction device which is responsive to the detecting means.

3. Apparatus according to claim 1 wherein the separating means comprises at least one fluid ejection device which is responsive to the detecting means.

4. Apparatus according to claim 3 wherein the drum has a plurality of apertures.

5. Apparatus according to claim 3 wherein the fluid ejection device ejects fluid to separate the particles with the at least one predetermined characteristic only in response to the presence of the at least one predetermined characteristic as detected by the detecting means.

6. Apparatus according to claim 1 which includes at least one chute into which the particles with the at least one predetermined characteristic are directed.

7. Apparatus according to claim 1 wherein the drum, on its said inner surface, includes a plurality of particle retaining formations.

8. Apparatus according to claim 7 wherein the particle retaining formations are ribs which are spaced from each other in the circumferential direction of the drum and which extend across the width of the drum.

9. A sorting assembly which includes a first apparatus according to claim 1, a second apparatus according to claim 1, and a transfer device, and wherein the said remaining particles of the first apparatus are directed to the transfer device which comprises the said means for feeding particulate material into the drum of the second apparatus so that reject material from the first apparatus is fed to the second apparatus.

10. A sorting assembly according to claim 9 wherein the drum of the first apparatus and the drum of the second apparatus are respective sections of a single drum.

11. Apparatus according to claim 1 wherein the stimulating means comprises a plurality of X-ray emitters disposed along a widthwise direction facing the inner surface of the drum, each X-ray emitter outputting X-rays towards a predetermined track width of the drum, and wherein the stimulating means comprises a plurality of X-ray detectors disposed along the widthwise direction facing the inner surface of the drum, each X-ray detector receiving signals from a corresponding predetermined track width of the drum.

12. Apparatus according to claim 11 wherein the particles with the at least one predetermined characteristic are diamonds which emit fluorescent light when impinged upon by X-rays, the fluorescent light being detected by at least one of the X-ray detectors.

13. Apparatus according to claim 1 wherein the monolayer adheres to the inner surface of the drum due substantially to the centrifugal force.

14. A method of sorting a particulate material which includes the steps of:

subjecting the particulate material to a centrifugal force thereby to form a monolayer of the particulate material so that individual particles are identifiable;

stimulating the particles so that particles which possess at least one predetermined characteristic emit a signal which indicates the presence of the at least one predetermined characteristic;

detecting the presence of the at least one predetermined characteristic in particles in the monolayer of the particulate material; and removing particles with the at least one predetermined characteristic from the monolayer of particulate material.

15. A method according to claim 14 wherein the particulate material is subjected to the centrifugal force by feeding the material into a rotating drum so that a monolayer of the particulate material is dispersed on an inner surface of the drum.

16. A method according to claim 15 wherein the particulate material is fed continuously into the drum and the particulate material remaining in the drum, after removal of the particles with the at least one predetermined characteristic, is removed continuously from the drum.

17. A method according to claim 14 wherein particulate material is removed from the drum by means of suction.

18. A method according to claim 14 wherein particulate material is removed from the drum by means of fluid pressure.

19. Apparatus for sorting a particular material, comprising:

a drum which is mounted for rotation about its axis;

a feeding unit that feeds the particulate material into the drum which, due to centrifugal force produced by its rotation, causes a monolayer of the particulate material to adhere to an inner surface of the drum;

a stimulating unit that stimulates the particulate material so that particles which possess at least one predetermined characteristic emit a signal which indicates the presence of the predetermined characteristic;

a detecting unit that detects the presence of the at least one predetermined characteristic in individual particles in the monolayer of the particulate material; and a separating unit that separates particles with the at least one predetermined characteristic from the remaining particles.

* * * * *